US006802093B1

(12) United States Patent
Pope-Brown

(10) Patent No.: US 6,802,093 B1
(45) Date of Patent: Oct. 12, 2004

(54) BED ASSEMBLY

(76) Inventor: Dionne Pope-Brown, 2346 E. Mason Ave., Baton Rouge, LA (US) 70805-1125

( * ) Notice: Subject to any disclaimer, the term of this patent is extended or adjusted under 35 U.S.C. 154(b) by 0 days.

(21) Appl. No.: 10/076,471

(22) Filed: Feb. 15, 2002

(51) Int. Cl.[7] ..... A61G 7/02; A61G 7/015
(52) U.S. Cl. ..... 5/604; 5/695
(58) Field of Search ..... 5/604, 606, 695, 5/699

(56) References Cited

U.S. PATENT DOCUMENTS

| | | | | | |
|---|---|---|---|---|---|
| 1,054,452 | A | * | 2/1913 | Sayen | 5/695 |
| 1,368,211 | A | * | 2/1921 | Kellum | 5/695 |
| 1,407,631 | A | * | 2/1922 | Brown | 5/604 |
| 1,844,864 | A | * | 2/1932 | Saunders | 5/604 |
| 1,903,901 | A | * | 4/1933 | Masslow | 5/604 |
| 1,949,035 | A | * | 2/1934 | Beurschgens | 5/695 |
| 1,959,728 | A | * | 5/1934 | Mathis | 5/604 X |
| 2,118,261 | A | * | 5/1938 | Marzano | 5/604 |
| 2,218,572 | A | * | 10/1940 | Dry | 5/604 |
| 2,615,175 | A | * | 10/1952 | Corakas | 5/695 X |
| 2,872,689 | A | * | 2/1959 | Fournet | 5/604 |
| 3,023,429 | A | | 3/1962 | Borotra et al. | |
| 3,833,945 | A | | 9/1974 | Moody | |
| 3,849,811 | A | * | 11/1974 | Cyll | 5/604 |
| 4,030,149 | A | * | 6/1977 | Kato | 5/604 |
| 4,490,865 | A | * | 1/1985 | Hamaguchi | 5/604 |
| 4,571,759 | A | * | 2/1986 | Sasaki et al. | 5/604 |
| 4,677,700 | A | | 7/1987 | Su | |
| 5,327,599 | A | | 7/1994 | Bradley | |
| 5,535,464 | A | * | 7/1996 | Salonica | 5/604 |
| D375,849 | S | | 11/1996 | Conrad | |
| 5,901,390 | A | | 5/1999 | Williams | |

FOREIGN PATENT DOCUMENTS

| | | | | |
|---|---|---|---|---|
| GB | 14028 A | * | 6/1896 | 5/604 |
| GB | 1169414 A | * | 11/1969 | 5/604 |

* cited by examiner

*Primary Examiner*—Robert G. Santos

(57) ABSTRACT

A bed assembly for permitting a user to urinate and defecate while lying in the bed assembly. The bed assembly includes a mattress that has an aperture extending through the mattress for permitting a user to urinate and defecate while lying on the mattress. The mattress is positionable between a lying position and a sitting position for permitting a user to urinate and defecate in a seated position. A plug member is removably positioned in the aperture of the mattress for plugging the aperture in the mattress. A frame is provided for supporting the mattress. A container is removably positionable under the aperture for receiving the urine and feces discharge of a user. A pair of guide rails is mounted to the frame for selectively receiving the container and positioning the container under the aperture in mattress.

16 Claims, 6 Drawing Sheets

BED ASSEMBLY

BACKGROUND OF THE INVENTION

1. Field of the Invention

The present invention relates to beds and more particularly pertains to a new bed assembly for permitting a user to urinate and defecate while lying in the bed assembly.

2.Description of the Prior Art

The use of beds is known in the prior art. More specifically, beds heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,901,390; U.S. Pat. No. 3,023,429; U.S. Pat. No. 4,667,700; U.S. Pat. No. 3,833,945; U.S. Pat. No. 5,327,599; and U.S. Pat. No. Des. 375,849.

While these devices fulfill their respective, particular objectives and requirements, the aforementioned patents do not disclose a new bed assembly. The inventive device includes a mattress that has an aperture extending through the mattress for permitting a user to urinate and defecate while lying on the mattress. The mattress is positionable between a lying position and a sitting position for permitting a user to urinate and defecate in a seated position. A plug member is removably positioned in the aperture of the mattress for plugging the aperture in the mattress. A frame is provided for supporting the mattress. A container is removably positionable under the aperture for receiving the urine and feces discharge of a user. A pair of guide rails is mounted to the frame for selectively receiving the container and positioning the container under the aperture in mattress.

In these respects, the bed assembly according to the present invention substantially departs from the conventional concepts and designs of the prior art, and in so doing provides an apparatus primarily developed for the purpose of permitting a user to urinate and defecate while lying in the bed assembly.

SUMMARY OF THE INVENTION

In view of the foregoing disadvantages inherent in the known types of beds now present in the prior art, the present invention provides a new bed assembly construction wherein the same can be utilized for permitting a user to urinate and defecate while lying in the bed assembly.

The general purpose of the present invention, which will be described subsequently in greater detail, is to provide a new bed assembly apparatus and method which has many of the advantages of the beds mentioned heretofore and many novel features that result in a new bed assembly which is not anticipated, rendered obvious, suggested, or even implied by any of the prior art beds, either alone or in any combination thereof.

To attain this, the present invention generally comprises a mattress that has an aperture extending through the mattress for permitting a user to urinate and defecate while lying on the mattress. The mattress is positionable between a lying position and a sitting position for permitting a user to urinate and defecate in a seated position. A plug member is removably positioned in the aperture of the mattress for plugging the aperture in the mattress. A frame is provided for supporting the mattress. A container is removably positionable under the aperture for receiving the urine and feces discharge of a user. A pair of guide rails is mounted to the frame for selectively receiving the container and positioning the container under the aperture in mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bed assembly apparatus and method which has many of the advantages of the beds mentioned heretofore and many novel features that result in a new bed assembly which is not anticipated, rendered obvious, suggested, or even implied by any of the prior art beds, either alone or in any combination thereof.

It is another object of the present invention to provide a new bed assembly which may be easily and efficiently manufactured and marketed.

It is a further object of the present invention to provide a new bed assembly which is of a durable and reliable construction.

An even further object of the present invention is to provide a new bed assembly which is susceptible of a low cost of manufacture with regard to both materials and labor, and which accordingly is then susceptible of low prices of sale to the consuming public, thereby making such bed assembly economically available to the buying public.

Still yet another object of the present invention is to provide a new bed assembly which provides in the apparatuses and methods of the prior art some of the advantages thereof, while simultaneously overcoming some of the disadvantages normally associated therewith.

Still another object of the present invention is to provide a new bed assembly for permitting a user to urinate and defecate while lying in the bed assembly.

Yet another object of the present invention is to provide a new bed assembly which includes a mattress that has an aperture extending through the mattress for permitting a user to urinate and defecate while lying on the mattress. The mattress is positionable between a lying position and a sitting position for permitting a user to urinate and defecate in a seated position. A plug member is removably positioned in the aperture of the mattress for plugging the aperture in the mattress. A frame is provided for supporting the mattress. A container is removably positionable under the aperture for receiving the urine and feces discharge of a user. A pair of guide rails is mounted to the frame for selectively receiving the container and positioning the container under the aperture in mattress.

Still yet another object of the present invention is to provide a new bed assembly that reduces injuries to the elderly and immobile. Elderly and immobile individuals often require assistance to use the bathroom. Often, assistance is not available for a period of time, leaving these individuals to attempt to reach the bathroom on their own. Unfortunately, they are often injured in their attempts to reach the bathroom. However, the present invention permits the elderly and immobile to use the bathroom from the comfort of their bed, eliminating the need to leave the bed to relieve themselves.

Even still another object of the present invention is to provide a new bed assembly that permits a user lying in bed to use the bathroom in a seated position. Prior to the present invention, users had the difficult task of urinating and defecating while lying down. The present invention is adjustable to position the user in a seated position making it easier for the individual to urinate and defecate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
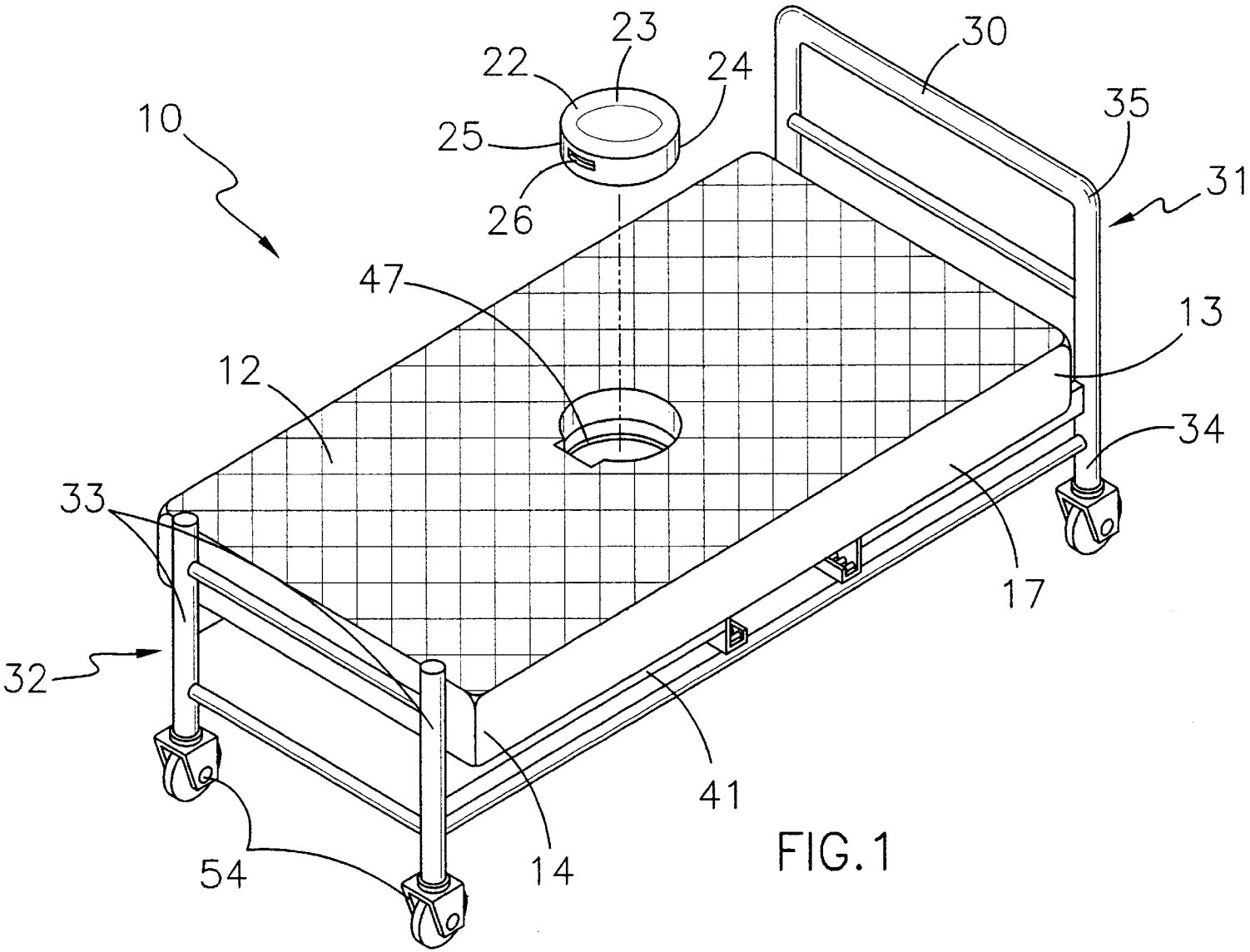
FIG. 1 is a schematic perspective view of a new bed assembly according to the present invention.

With reference now to the drawings, and in particular to FIGS. 1 through 6 thereof, a new bed assembly embodying the principles and concepts of the present invention and generally designated by the reference numeral 10 will be described.

As best illustrated in FIGS. 1 through 6, the bed assembly 10 generally comprises a mattress 12, a frame 30, a pair of guide rails mounted to the frame for receiving a container 60. Users unable to or that find it difficult to get out of bed may use the container 60 to use the bathroom while in bed. The mattress 12 has a first end 13, a second end 14, an upper surface 15, a lower surface 16 and a pair of lateral side surfaces 17. The mattress 12 may include a longitudinal axis extending between the first 13 and second 14 ends of the mattress 12.

Figure 3:
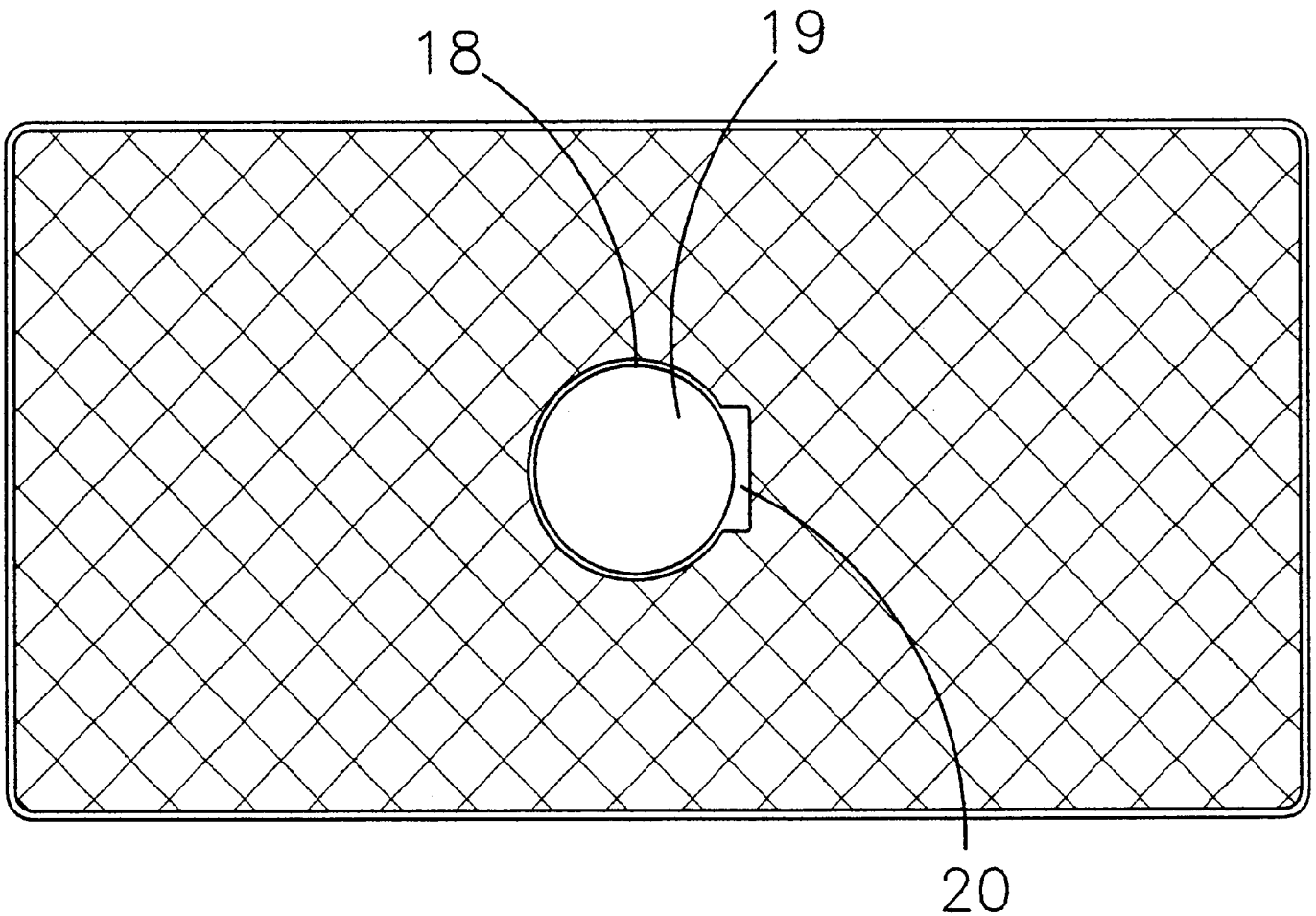
FIG. 3 is a schematic top view of the present invention showing an aperture extending through a mattress.

As illustrated in FIGS. 1 and 3, the upper 15 and lower 16 surfaces of the mattress 12 include an annular edge 18 defining an aperture 19 extending through the upper 15 and lower 16 surfaces of the mattress 12. The aperture 19 may be positioned generally an equal distance between the first 13 and second 14 ends of the mattress 12 and may also be positioned an equal distance between the pair of lateral side surfaces 14 of the mattress 12 to for positioning the aperture below a bottom of a user.

As illustrated in FIGS. 1 and 3, the annular edges 18 defining the aperture 19 may include a channel 20 extending into the mattress 12. The channel 20 may extend from the aperture 19 toward the second end 14 of the mattress 12. However, the channel 20 may also extend in any direction of the mattress 12.

The mattress is preferably positionable between a lying position and a sitting position. In one embodiment of the present invention, the lying position is characterized by a user being in a supine position when on the mattress 12. The sitting position is characterized by a user being in a seated position when on the mattress 12. The first end 13 of the mattress 12 is positioned generally away from the frame in the sitting position such that the mattress 12 supports a back of a user sitting on the mattress 12.

The mattress 12 may comprise a substantially compressible material such as, for example, a foam or rubber material. However, other materials may also be employed.

As illustrated in FIG. 1, a plug member 22 is provided for plugging the aperture 19 in the mattress 12. The plug member 22 includes an upper surface 23, a lower surface 24 and a peripheral edge surface 25. In one embodiment of the present invention, the plug member 22 is removably positioned in the aperture 19 when a user is not discharging urine or feces. The upper surface 23 of the plug member 22 is preferably flush with the upper surface 15 of the mattress 12 for providing a more comfortable mattress 12 for a user lying on the mattress 12.

The peripheral edge surface 25 of the plug member 22 may include an opening 26 for receiving a hand of a user removing the plug member 22 from the aperture 19 of the mattress 12. In one embodiment of the present invention, the opening 26 in the plug member 22 is accessible to a hand of a user positioned in the channel 20 in the mattress 12.

The plug member 22 may comprise a substantially compressible material such as, for example, a foam or rubber material. However, other materials may also be employed.

Figure 4:
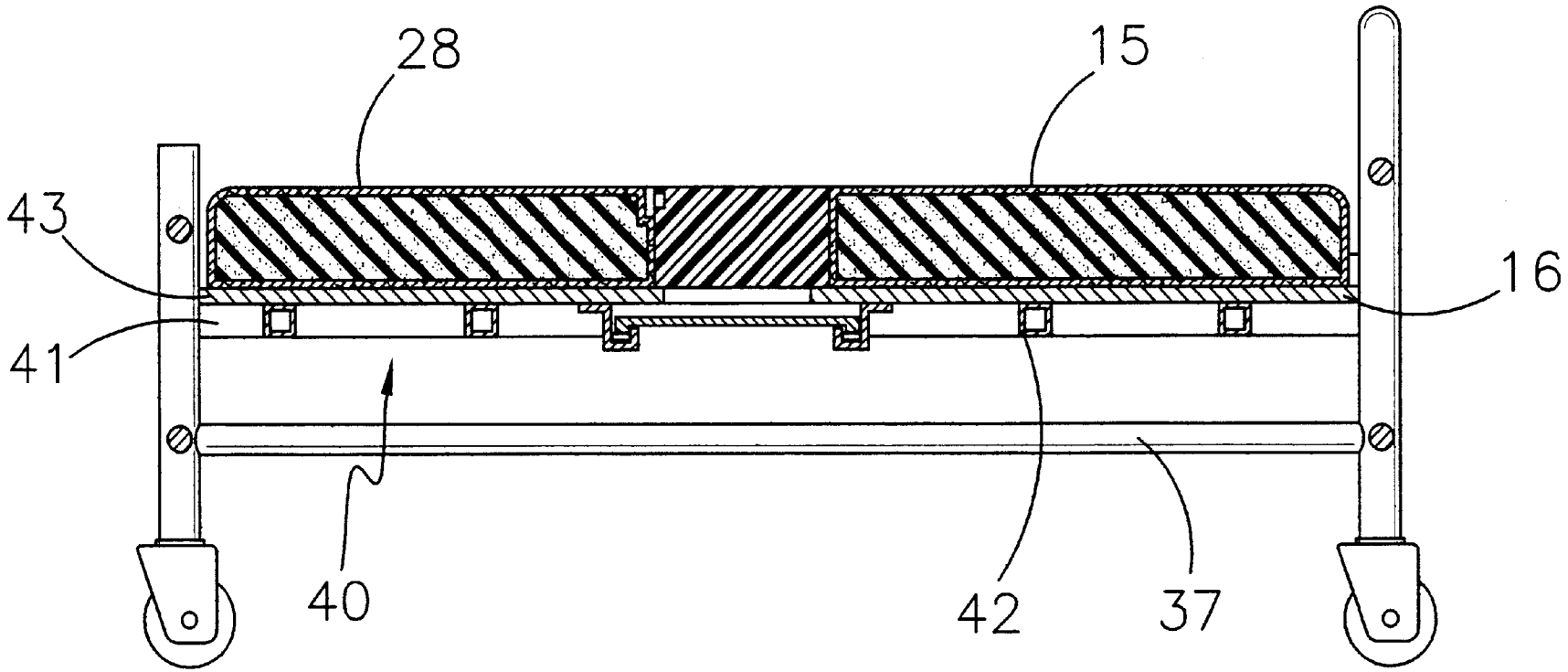
FIG. 4 is a schematic cross-sectional view of the present invention.

As illustrated in FIG. 4, a cover means 28 may be provided for covering the mattress 12. The cover means 28 is mounted on and extends about the upper 15, lower 16, and peripheral side 17 surfaces of the mattress 12. Since a user will be urinating and defecating while on the mattress 12, the cover means 28 preferably comprises a generally flexible and impermeable material. The cover 28 may comprise a plastic that would protect the mattress 12 from the urine and feces discharged from the user.

The frame 30 for supporting the mattress 12 may include a head assembly 31 and a foot assembly 32. The head assembly 31 and the foot assembly 32 each has a pair of spaced leg members 33 orientated generally parallel to each other. Each of the leg members 33 has first 34 and second 35 opposed ends with the first ends 34 being positioned generally closer to a ground surface than the second ends 35. The head assembly 31 is positioned generally adjacent to the first end 13 of the mattress 12 and the foot assembly is positioned generally adjacent to the second end 14 of the mattress 12.

Figure 2:
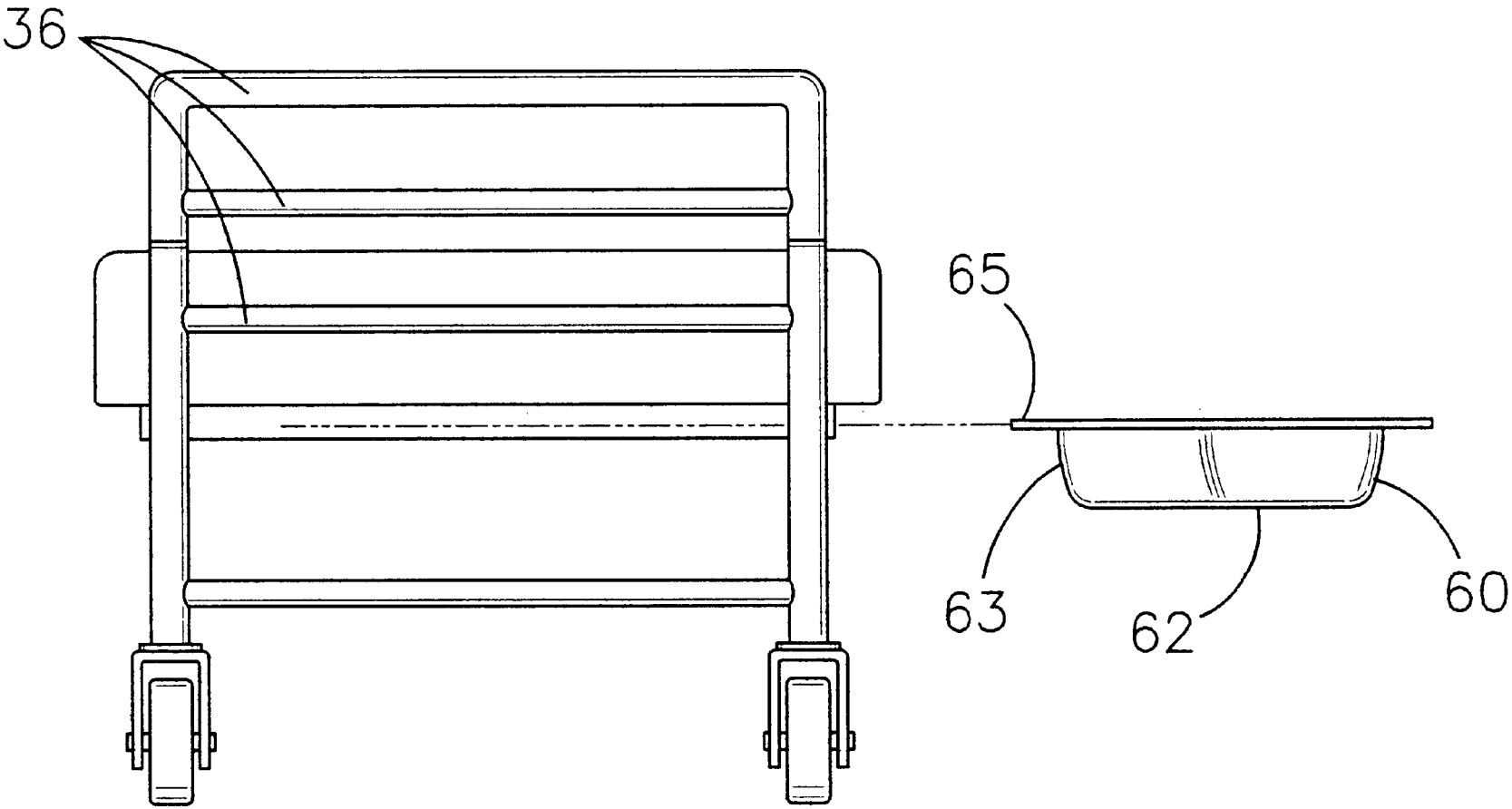
FIG. 2 is a schematic frontal view of the present invention.

As illustrated in FIG. 2, a plurality of elongated coupling members 36 may be provided for coupling together the pair of leg members 33 of the head assembly 31 of the frame 30 and for coupling together the pair of leg members 33 of the foot assembly 32 of the frame 30. Each of the coupling members 36 extends between and is coupled to each of the leg members 33 of the head assembly 31 and the foot assembly 32.

As illustrated in FIGS. 1 and 4, a pair of joining members 37 may be provided for joining the head assembly 31 and the foot assembly 32 of the frame 30 together. Each of the joining members 37 is mounted to and extends between the pair of leg members 33 of the head assembly 31 and the foot assembly of the frame 30. Each of the joining members 37 may be positioned generally nearer the first end 34 of each of the leg members 33 than the second end 35 of each of the leg members 33.

The frame 30 may also include a support assembly 40 for supporting the mattress 12 on the frame 30. The support assembly 40 of the frame 30 may include a pair of elongated side supports 41 that extend between and that are coupled to the pair of leg members 33 of the head assembly 31 and the foot assembly of the frame 30. The pair of elongated side supports 41 may be positioned generally adjacent to each of the joining members 37.

As illustrated in FIG. 4, a plurality of cross supports 42 may be provided for connecting each of the side supports 41 together. Each of the cross supports 42 is preferably coupled to extends between the pair of side supports 41. Each of the cross supports 42 may be spaced apart between the head assembly 31 and the foot assembly 32 of the frame 30.

The support assembly 40 may also include a sheet support 43 for supporting the mattress 12. The sheet support 43 has generally planar upper 44 and lower 45 surfaces. The sheet support 43 may be pivotally mounted on the pair of side supports 41 and the plurality of cross supports 42. The sheet support 43 may comprise a substantially rigid material such as, for example, a plastic or metal material.

As illustrated in FIG. 4, the sheet support 43 has an opening 47 extending through the upper 44 and lower 45 surfaces of the sheet support 43. The opening 47 of the sheet support 43 is in registration with the aperture 19 of the mattress 12 for permitting urine and feces to pass through the sheet support 43.

The sheet support 43 may include a head portion 50 and a foot portion 51 that are pivotally coupled together. In one embodiment of the present invention, the head portion 50 of the sheet support 43 is positioned generally adjacent to the head assembly 31.

A hinging means 52 may be provided for coupling the head 50 and foot 51 portions of the sheet support 43 together. The hinging means 52 extends between and is coupled to an edge of the head 50 and foot 51 portions of the sheet support 43. The hinging means 52 is preferably positioned generally adjacent to the opening 47 in the sheet support 43 and the aperture 19 in the mattress 12 for positioning a user over the aperture 19 in the sitting position of the mattress 12.

Beds are generally moved periodically, therefore, a plurality of castors 54 may be provided for moving the frame 30. Each of the castors 54 is preferably mounted on the first end 34 of each of the leg portions 33 of the head assembly 31 and the foot assembly 32.

Figure 5:
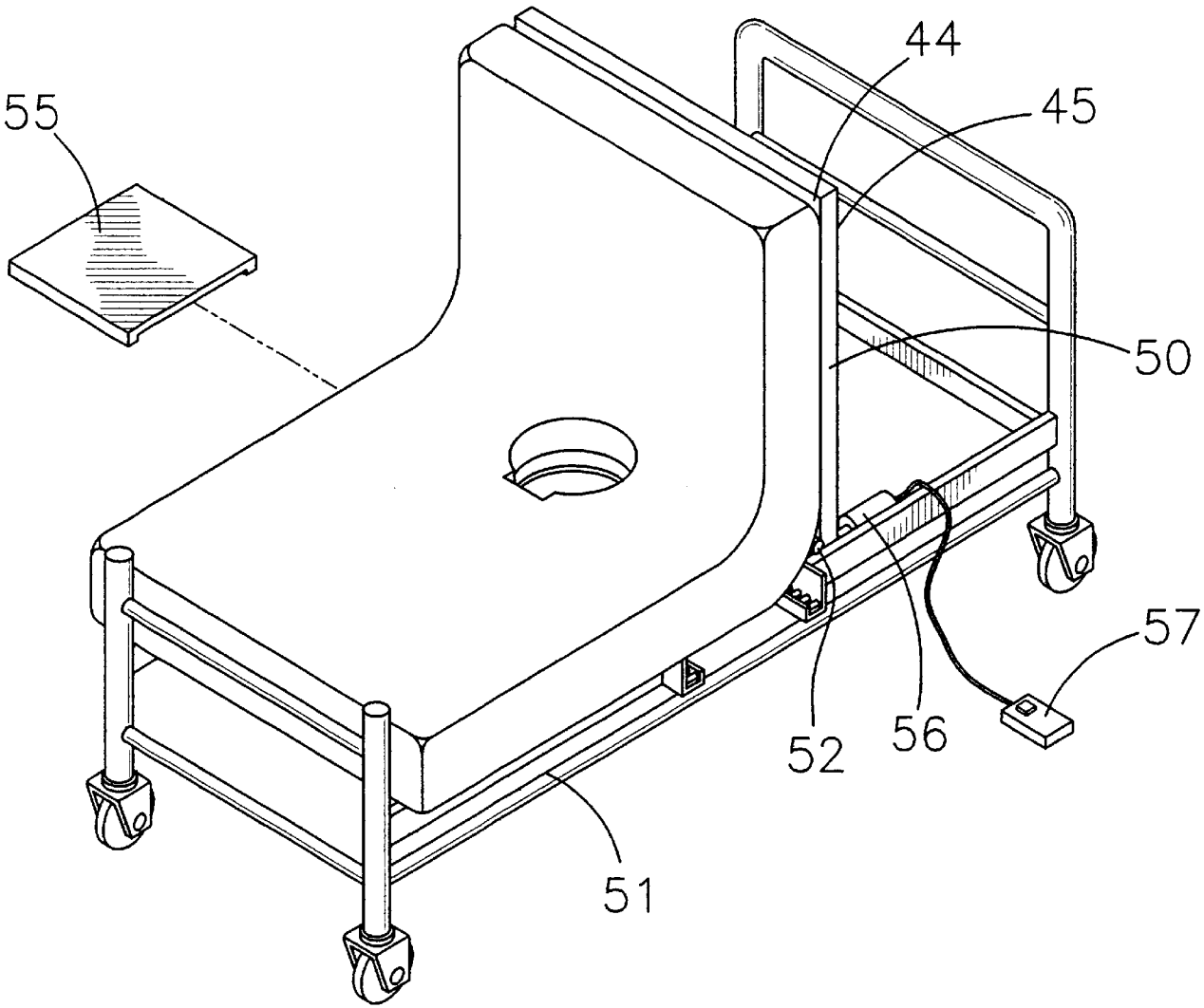
FIG. 5 is a schematic perspective view of the present invention showing the mattress in a sitting position.

As illustrated in FIG. 5, a supporting means 55 may be removably positionable between the mattress 12 and the frame 30 for supporting the plug member 22 in the aperture 19 of the mattress 12 and for preventing the plug member 22 from falling through the aperture 19. The supporting means 55 preferably includes a width generally greater than a diameter of the aperture 19 of the mattress 12. The supporting means 55 may comprise a thin plate having a pair of generally planar surfaces such that a user lying on the mattress 12 does not feel the securing means 55 positioned under the mattress 12. However, other types of securing means 55 may be employed.

As illustrated in FIG. 5, a lifting means 56 may be provided for lifting the mattress 12 between the lying position and the sitting position. The lifting means 56 may be mountable to and may extend between the pair of side supports 41 and the head portion 50 of the sheet support 43. The lifting means 56 may also be positioned generally between the pair of side supports 41. The lifting means 56 may comprise a motor designed to lift the head portion 50 of the sheet support 43. Other types of lifting means such as, for example, hydraulics lifts may also be employed.

An actuating means 57 may be provided for controlling the lifting means 56. The actuating means 57 may be electrically connected to the lifting means 56. The actuating means 57 may comprise a switch.

The container 60 for receiving the urine and feces discharge of a user may have an open top 61, a bottom wall 62, and a peripheral wall 63 extending between the open top 61 and the bottom wall 62 defining an interior 64 of the container 60. The container 60 is positionable under the aperture 19 in the mattress 12 and under the opening 47 in the support member 43. In one embodiment of the present invention, a user lying on the mattress 12 urinates and defecates into the container 60.

The container 60 may include an annular lip portion 65 extending away from the peripheral wall 63 of the container 60. The annular lip portion 65 may be positioned generally adjacent to the open top 61 of the container 12 and may be orientated generally perpendicular to the peripheral wall 63 of the container 12.

The container 60 may comprise a substantially rigid material such as, for example, stainless steel or a plastic. The container 60 may comprise a material capable of withstanding high temperatures for sterilizing the container 60.

The pair of guide rails 68 is mounted to and extends between the pair of side supports 41 of the frame 30. Each of the guide rails 68 is preferably positioned on opposite sides of the opening 47 in the sheet support 43. Each of the guide rails 68 includes a pair of opposite ends 76 and a longitudinal axis extending between the pair of opposite ends 76 of each of the guide rails 68.

Figure 6:
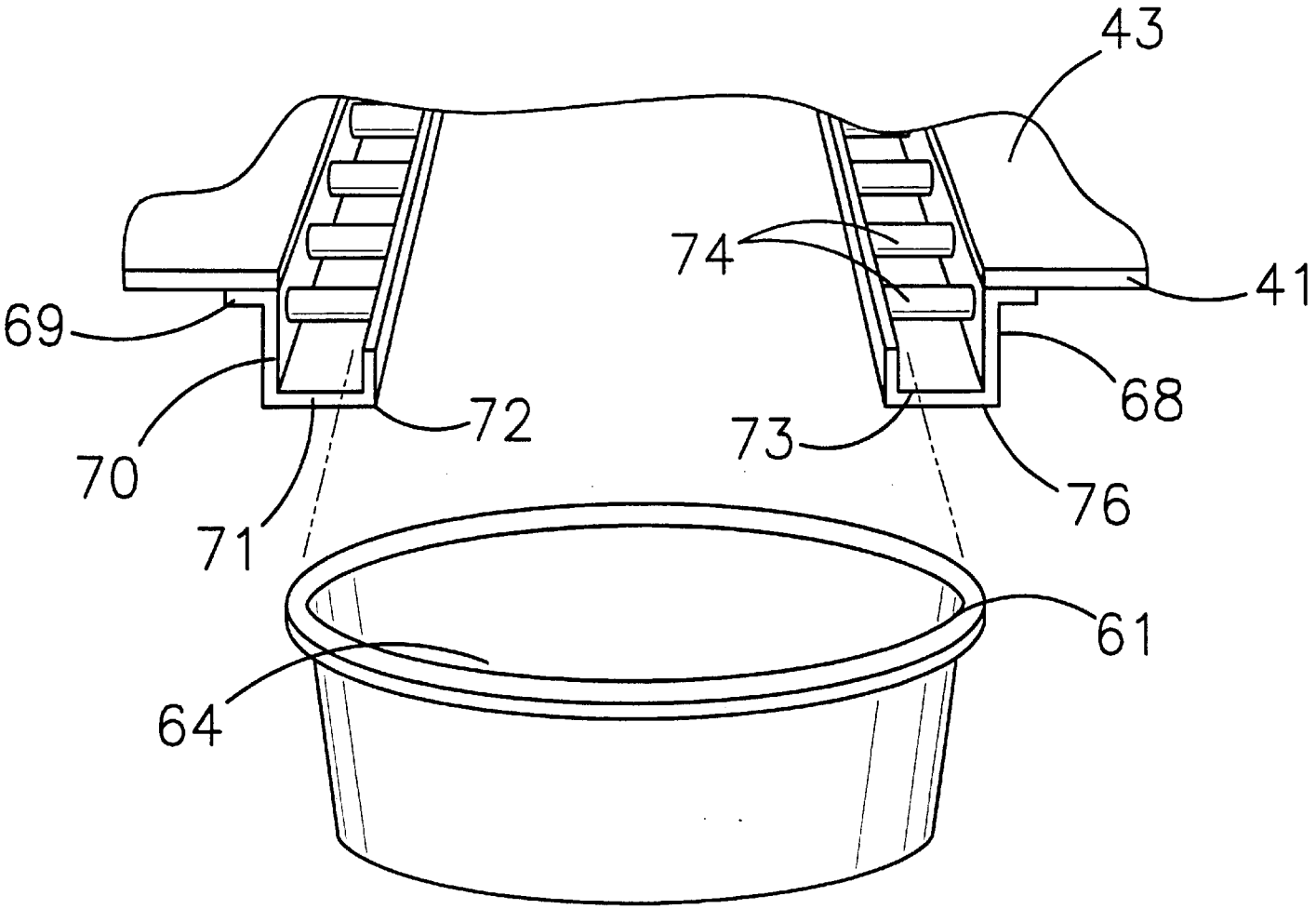
FIG. 6 is a schematic side view of the present invention showing a pair of guide rails mounted to a frame of the bed assembly.

As illustrated in FIG. 6, each of the guide rails 68 may include a mounting portion 69 for mounting each of the guide rails 68 to the side supports 41. The mounting portion 69 may be welded to the side supports 41. Additionally, the mounting portion 69 may be fastened to the side supports 41 with a fastening means extending through the mounting portion 69 and into the side supports 41.

Each of the guide rails 68 may also include a leg portion 70 extending downwardly away from the mounting portion 69. The leg portion 70 of each of the guide rails 68 may be orientated generally perpendicular to the mounting portions 68 of each of the guide rails 68 such that the leg portions 70 and mounting portions are at right angles to each other.

Each of the guide rails 68 may additionally include a foot portion 71 for selectively receiving the annular lip portion 65 of the container 60. The foot portions 71 preferably extend away from the leg portions 70 and are preferably orientated generally perpendicular to the leg portions 70 such that the foot 71 and leg 70 portions are at right angles to each other.

As particularly illustrated in FIG. 7, the foot portion 71 of each of the guide rails 68 may also include a bend 72 therein such that a portion of the foot portions 71 is orientated generally parallel to the leg portions 70. The bend 72 of the foot portions 71 defines a channel 73 of each of the guide rails 68. Each of the guide rails 68 is generally U-shaped such that each of the guide rails 68 includes a generally U-shaped transverse cross section taken substantially perpendicular to the longitudinal axis of each of the guide rails 68.

A plurality of rollers 74 may be rotatably mounted in the channel 73 of each of the guide rails 68 for positioning the container 60 under the aperture 19 in the mattress 12 and the opening 47 in the sheet support 43. Each of the rollers 74 is rotatably coupled to and extends between the leg portions 70 and the portion of the foot portions 71 parallel to the leg portions 70 of the pair of guide rails 68.

In use, a user lying on the mattress or an assistant helping the user rolls the user to their side and removes the plug member 22. The plug member 22 is removed by inserting a hand into the opening 26 of the plug member 22 and pulling. Once the plug member 22 is removed the user is positioned on their back and a bottom of the user is positioned over the aperture 19 in the mattress 12. The assistant or user inserts the container 60 into the guide rails 68 and positions it under the opening 47 of the sheet support 43. The user lying on the mattress 12 may then urinate and defecate into the container 60. The container 60 is then removed from the pair of guide rails 68 and emptied into a toilet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed assembly for permitting a user to urinate and defecate while lying in said bed assembly, said assembly comprising:

a mattress having an aperture extending through said mattress;

said mattress being positionable between a lying position and a sitting position;

a plug member being removably positioned in said aperture of said mattress for selectively plugging said aperture in said mattress;

a frame for supporting said mattress;

a container being positionable under said aperture for receiving the urine and feces discharge of a user;

a pair of guide rails being mounted to said frame for selectively receiving said container and positioning said container under the aperture in said mattress;

wherein said frame includes a head assembly and a foot assembly each having a pair of spaced leg members, and a support assembly being coupled to and extending between said head assembly and foot assembly for supporting said mattress;

wherein each of said guide rails includes a mounting portion for mounting each of said guide rails to said support assembly;

wherein each of said guide rails includes a leg portion extending downwardly away from said mounting portion;

wherein each of said guide rails includes a foot portion for selectively receiving said container, said foot portion extending away from said leg portion;

wherein said foot portion of each of said guide rails has a bend therein such that a portion of said foot portions is orientated generally parallel to said leg portions of each of said guide rails, said bend of each of said foot portions defining a channel of each of said guide rails; and a plurality of rollers being rotatably mounted in said channel of each of said guide rails for supporting said container under said aperture in said mattress and under said opening in said sheet support.

2. The bed assembly of claim 1, wherein an upper surface of said plug member is flush with an upper surface of said mattress when said plug is inserted into said aperture.

3. The bed assembly of claim 1, wherein a portion of said mattress adjacent to said aperture has a channel extending from said aperture into said mattress; and said plug member having a peripheral edge surface having an opening for receiving a hand of a user for removing said plug member from said aperture of said mattress, wherein said opening in said plug member is accessible to a hand of a user through said channel in said mattress when said plug member is inserted into said aperture.

4. The bed assembly of claim 1, additionally including a supporting means being removably positionable between said mattress and said frame for supporting said plug member in said aperture of said mattress and for preventing said plug member from falling out of said aperture, said supporting means having a width generally greater than a diameter of said aperture.

5. The bed assembly of claim 4, wherein said supporting means comprises a plate.

6. The bed assembly of claim 1, wherein said lying position is characterized by a user being supported by said mattress in a supine position when resting on said mattress, wherein said sitting position is characterized by a user being supported by said mattress in a seated position when resting on said mattress.

7. The bed assembly of claim 1, additionally including a cover for covering said mattress, said cover being mounted on and extending about said mattress, said cover comprising a generally flexible and impermeable material for protecting said mattress.

8. The bed assembly of claim 1, additionally including a plurality of elongated coupling members for coupling said pair of leg members of said head assembly together and for coupling said pair of leg members of said foot assembly together, each of said coupling members extending between and being coupled to each of said leg members of said head assembly and said foot assembly.

9. The bed assembly of claim 1, additionally including a pair of joining members for joining said head assembly and said foot assembly of said frame together, each of said joining members being mounted to and extending between said pair of leg members of said head assembly and said foot assembly of said frame.

10. The bed assembly of claim 1, wherein said support assembly includes:

a pair of elongated side supports, each of said side supports extending between and being coupled to said pair of leg members of said head assembly and said foot assembly of said frame, wherein said guide rails extend between and are coupled to said pair of side supports;

a plurality of cross supports for connecting each of said side supports together, each of said cross supports being coupled to and extending between said pair of side supports; and a sheet support being pivotally mounted on said pair of side supports for supporting said mattress, wherein said sheet support has an opening extending therethrough, said opening being in substantial registration with said aperture of said mattress.

11. The bed assembly of claim 10, wherein said sheet support has a head portion and a foot portion pivotally coupled together such that said head portion is pivotable in an upward direction to support said mattress in said sitting position.

12. The bed assembly of claim 1, additionally including a plurality of casters being mounted on said frame for rolling said frame over a surface.

13. The bed assembly of claim 1, additionally including a lifting means for lifting a portion of said mattress between said lying position and said sitting position, said lifting means being mounted to and extending between said frame and said mattress.

14. The bed assembly of claim 13, additionally including an actuating means for controlling said lifting means, said actuating means being operatively connected to said lifting means.

15. The bed assembly of claim 1, wherein said container has an annular lip portion extending away from a peripheral wall of said container.

16. A bed assembly for permitting a patient lying in said bed assembly to urinate and defecate while lying in said bed assembly, said assembly comprising:

a mattress having a first end, a second end, an upper surface, a lower surface and a pair of lateral side surfaces, said mattress having an longitudinal axis extending between said first and second ends of said mattress;

said upper and lower surfaces of said mattress having an annular edge defining an aperture extending through said upper and lower surfaces of said mattress, said aperture being positioned generally an equal distance between said first and second ends of said mattress and an equal distance between said pair of lateral side surfaces of said mattress;

said annular edges defining said aperture having a channel extending into said mattress, said channel extending from said aperture toward said second end of said mattress;

said mattress being positionable between a lying position and a sitting position, wherein said lying position is characterized by a user being supported by said mattress in a supine position when resting on said mattress, wherein said sitting position is characterized by a user being supported by said mattress in a seated position when resting on said mattress;

said mattress comprising a compressible material;

a plug member for plugging said aperture in said mattress, said plug member having an upper surface, a lower surface and a peripheral edge surface, wherein said plug member is removably positioned in said aperture when a user is not discharging urine or feces;

said peripheral edge surface of said plug member having an opening for receiving a hand of a user for removing said plug member from said aperture of said mattress, wherein said opening in said plug member is accessible to a hand of a user through said channel in said mattress;

said plug member comprising a compressible material;

a cover for covering said mattress, said cover being mounted on and extending about said mattress;

said cover comprising a generally flexible and impermeable material for protecting said mattress from urine and feces discharged from a user;

a frame for supporting said mattress, said frame including:

a head assembly having a pair of spaced leg members, each of said leg members having first and second opposed ends, said head assembly being positioned generally adjacent to said first end of said mattress, said pair of leg members being orientated generally parallel to each other;

a foot assembly having a pair of spaced leg members, each of said leg members of said foot portion having first and second opposed ends, said foot assembly being positioned generally adjacent to said second end of said mattress, said pair of leg members of said foot assembly being orientated generally parallel to each other;

a plurality of elongated coupling members for coupling together said pair of leg members of said head assembly of said frame and for coupling together said pair of leg members of said foot assembly of said frame, each of said coupling members extending between and being coupled to said pair of leg members of said head assembly and being coupled to and extending between said pair of leg members of said foot assembly;

a pair of joining members for joining said head and foot assemblies of said frame together, each of said joining members being mounted to and extending between said pair of leg members of said head and foot assemblies of said frame, each of said joining members being positioned generally nearer said first end of each of said leg members than said second end of each of said leg members a support assembly for supporting said mattress, said support assembly of said frame including:

a pair of elongated side supports, each of said side supports extending between and being coupled to said pair of leg members of said head and foot assemblies of said frame, said pair of elongated side supports being positioned generally adjacent to each of said joining members;

a plurality of cross supports for connecting each of said side supports together, each of said cross supports being coupled to extending between said pair of side supports;

each of said cross supports being spaced apart between said head and foot assemblies of said frame;

a sheet support for supporting said mattress, said sheet support having generally planar upper and lower surfaces, said sheet support being pivotally positioned on said pair of side supports and said plurality of cross supports;

said sheet support comprising a substantially rigid material;

said sheet support having an opening extending through said upper and lower surfaces of said sheet support, said opening being in substantial registration with said aperture of said mattress;

said sheet support having a head portion and a foot portion pivotally coupled together, wherein said head portion of said sheet support is positioned generally adjacent to said head assembly;

a hinging means for coupling said head and foot portions of said sheet support, said hinging means extending between and being coupled to an edge of said head and foot portions of said sheet support, said hinging means being positioned generally adjacent to said opening in said sheet support and said aperture in said mattress;

a plurality of casters for moving said frame, each of said casters being mounted on said first end of each of said leg portions of said foot and head assemblies;

a supporting means being removably positionable between said mattress and said frame for supporting said plug in said aperture of said mattress and preventing said plug from falling out of said aperture, said supporting means having a width generally greater than a diameter of said aperture of said mattress, said supporting means comprising a plate;

a lifting means for lifting a portion of said mattress between said lying position and said sitting position, said lifting means being mountable to and extending between said pair of side supports and said head portion of said sheet support, said lifting means being positioned generally between said pair of side supports;

said lifting means comprising a motor adapted to lift said head portion of said sheet support;

an actuating means for controlling said lifting means, said actuating means being operatively connected to said lifting means;

a container for receiving the urine and feces discharge of a user, said container having an open top, a bottom wall, and a peripheral wall extending between said open top and said bottom wall defining an interior of said container, said container being positionable under said aperture in said mattress and said opening in said support member;

said container having an annular lip portion extending away from said peripheral wall of said container, said annular lip portion being positioned generally adjacent to said open top of said container, said annular lip being orientated generally perpendicular to said peripheral wall of said container;

a pair of guide rails for supporting said container, each of said guide rails being mounted to and extending between said pair of side supports, each of said guide rails being positioned on opposite sides of said opening in said sheet support, each of said guide rails having a pair of opposite ends, each of said guide rails having longitudinal axis extending between said pair of opposite ends, each of said guide rails including:

a mounting portion for mounting each of said guide rails to said side supports;

a leg portion extending downwardly away from said mounting portion, said leg portion of each of said guide rails being orientated generally perpendicular to said mounting portion;

a foot portion for selectively receiving said annular lip portion of said container, said foot portion extending away from said leg portion, said foot portion of said guide rail being orientated generally perpendicular to said leg portion of said guide rail;

said foot portion of each of said guide rails having a bend therein such that a portion of said foot portion is orientated generally parallel to said leg portion, said bend of each of said foot portions defining a channel of each of said guide rails;

each of said guide rails being generally U-shaped, such that each of said guide rails having a generally U-shaped transverse cross section taken substantially perpendicular to said longitudinal axis of each of said guide rails; and a plurality of rollers being rotatably mounted in said channel of each of said guide rails for positioning said container under said aperture in said mattress and said opening in said sheet support, each of said rollers being rotatably coupled to and extending between said leg portion and said foot portion of said pair of guide rails.

* * * * *